United States Patent [19]

Salvatore

[11] Patent Number: 5,002,313

[45] Date of Patent: Mar. 26, 1991

[54] PROMOTIONAL COUPONS

[76] Inventor: Carmine Salvatore, P.O. Box 3027, Stamford, Conn. 06905

[21] Appl. No.: 234,380

[22] Filed: Aug. 19, 1988

[51] Int. Cl.[5] ..... B42D 15/00

[52] U.S. Cl. ..... 283/102; 283/51; 283/56; 283/901; 283/903

[58] Field of Search ..... 283/100, 101, 102, 48.1, 283/49, 51, 56, 901, 903; 40/299; 434/346

[56] References Cited

U.S. PATENT DOCUMENTS

| | | | |
|---|---|---|---|
| 3,455,575 | 7/1969 | Seidman | 283/102 |
| 3,497,242 | 2/1970 | Seidman | 283/102 |
| 3,918,174 | 11/1975 | Miller et al. | 283/102 |
| 4,307,900 | 12/1981 | Krautsack | 283/56 |
| 4,345,393 | 7/1982 | Price et al. | 40/312 |
| 4,508,513 | 4/1985 | Donovan | 283/102 X |
| 4,627,643 | 12/1986 | Leonetti et al. | 283/102 |
| 4,817,990 | 4/1989 | Krost | 283/101 |

FOREIGN PATENT DOCUMENTS

| | | | |
|---|---|---|---|
| 1555462 | 11/1979 | United Kingdom | 283/102 |

*Primary Examiner*—Paul A. Bell
*Assistant Examiner*—Hwei-Siu Payer
*Attorney, Agent, or Firm*—Neuman, Williams, Anderson & Olson

[57] ABSTRACT

Improved promotional coupons provided with a plurality of illustrations covered by irreversibly removable concealment layer for identifying a number of objects, one of which is selected by a recipient of a coupon. The objects are a number of competing objects and uncovering one of the illustrations effects a choice of one of the competing products. Each illustration uncovered reveals a hidden redemption value. The coupon cannot be redeemed if more than one of the competing objects is selected.

9 Claims, 3 Drawing Sheets

PROMOTIONAL COUPONS

BACKGROUND OF THE INVENTION

1. Field of the Invention

This invention relates to promotional coupons and methods and more particularly to promotional coupons which have such a physical construction and configuration and which are so usable as to pique the interest of recipients of coupons and to otherwise invoke participation by the recipients to promote sales of products or services. The coupons and methods are also such as to provide issuers with a ready source of valuable information which would otherwise be difficult to obtain.

2. Background of the Prior Art

In marketing consumer products it is common to offer cents-off coupons by mail or through Sunday supplements. These coupons generally offer a specified amount off a particular consumer product on purchase and presentation of the coupon at a supermarket check out counter. In other promotions the consumer is offered a rebate through purchasing product being promoted with the rebate realized on returning a coupon to the manufacturer and receiving the rebate through the mail at a later date.

Other kinds of promotional schemes are revealed in the prior art including the Seidman U.S. Pat. No. 3,455,575 directed to a promotional card for providing bank account gifts in which the donor presents the gift recipient with a card which reveals the amount of the gift as the recipient erases an obscuring material on the card. The purpose of the Seidman card is to facilitate the gift and to interest the recipient, generally a child, in a savings account. The Seidman promotional card also includes a detachable tab so that the issuing bank can verify the value of the card.

Also of interest is Leonetti, et al U.S. Pat. No. 4,627,643 directed to a contest card in which the value of the card is obscured by a coating and in which the card provides an abrasive material for removing the coating to expose the value of the card.

Another promotional coupon is revealed in the prior Krautsack U.S. Pat. No. 4,307,900 in which a consumer is provided with a promotional coupon having place for receiving one or more proof of purchase seals which were applied to the coupon and returned to the manufacturer for the premium offer.

Coupons have also been proposed for issuance by two competing manufacturers who would cooperate in a challenge match between competing products. It was proposed that illustrations of the two competing products be provided on opposite sides of a central portion of the coupon and that a choice of one of the products be made, and/or a redemption value be obtained on a next purchase thereof, by tearing away a section of the coupon containing both the illustration and the central portion of the coupon, dashed tear lines of different colors being provided on the coupon.

Although a number of the coupons as proposed in the prior art have enjoyed substantial success, many have had little or no success, apparently because the coupons have not attracted sufficient interest or because they have required procedures which are too complicated or are otherwise unattractive to recipients of the coupons or to issuers of the coupons.

SUMMARY OF THE INVENTION

This invention was evolved with the general object of providing improved promotional coupons and methods for inducing greater interest in people exposed to coupons, with increased incentives for redemption thereof and for also providing valuable information to issuers of coupons.

Important aspects of the invention relate to the recognition of both the merits of prior art proposals and the weaknesses and problems associated therewith. In accordance with the invention, redemption coupons are provided in which a plurality of identification means are provided on a base member of sheet material, for identifying a number of objects one of which is to be selected by a recipient of each coupon. In illustrated embodiments, the identified objects are competing products which may preferably be identified by providing illustrations thereof. The recipient's interest is piqued by the implied request for an opinion as to the merits of the competing products or other identified objects and, in accordance with the invention, the selection of a product or other object is encouraged and facilitated in a manner such as to enhance the likelihood of redemption and to obtain other desirable results.

A specific feature of the coupons relates to the provision of a means for selecting each identified object, each selection means being such as to reveal a hidden redemption value upon making the selection. With this feature, the recipient's interest is additionally aroused by the prospect of a reward and by the recipient's natural curiosity in finding out the unknown nature of the reward.

In accordance with a further specific feature of the invention, the redemption values are covered by irreversibly removable concealment means, preferably in the form of a layer of rub-out material, such that a coupon cannot be validly redeemed if more than one of the competing objects is selected. This feature has the very important advantage that the issuer of coupons obtains information as to the recipient's choice between the competing objects.

A further feature relates to the use of the coupons to promote products of an issuer of the coupons while also providing information as to the user's preference with respect to competing products or other objects. In accordance with this feature, redemption values associated with all selection means are for redemption of products of the issuer. Thus, in the case where a selection is made between competing products, the recipient who selects a product of the issuer will be encouraged to make further purchases from the issuer while a recipient who selects a competing product will be influenced to make a switch to products of the issuer when making future purchases.

Still another specific feature of the invention relates to the provision of a number of selection means for each identified object, for providing the recipient with further inducements for participation in the selection process. In an illustrated embodiment, five selection means are provided for each of two identified objects and the recipient of the coupon is asked to select three out of the five which correspond to the selected item, the redemption value being dependent upon which three out of the five are selected. The recipient is thus stimulated to participate by making a selection and redeeming the coupon.

Further important features relate to the physical construction of the redemption coupons and to the physical relationship of the object identifications and selection means thereof. In an illustrated embodiment, an orthogonal format is provided in which the base member as presented to a recipient has a pair of horizontally extending upper and lower edges and a pair of vertically extending left and right edges. Each illustration or other object-identifying means is located in registry with the other object-identifying means and each selection means is located in registry with selection means for another object, along lines which are parallel to an imaginary reference line which may be parallel to one the two pairs of edges, e.g. along vertical lines, while each selection means is located in registry with the corresponding object-identifying means along a line transverse to the reference line, e.g. along a horizontal line. This orthogonal format encourages the selection process and also facilitates the correlation of the selection means and the identified objects, one of which is to be selected by the user. It also is desirable in connection with the provision of instructions and rules on the coupons in the form of printed text on horizontal lines, preferably disposed between the identifying and selection means associated with one object and those associated with another.

The invention includes a number of features which may be selected and combined to provide a very large number of possible formats all of which encourage participation by recipients in the selection process and facilitate the promotional objectives of an issuer of the coupons. The issuer may select from such formats the combination of features which best serve the information-gathering and promotional purposes of the issuer of the coupons.

The invention contemplates other objects, features and advantages which will become more fully apparent from the following detailed description taken in conjunction with the accompanying drawings.

DESCRIPTION OF PREFERRED EMBODIMENTS

Figure 1:
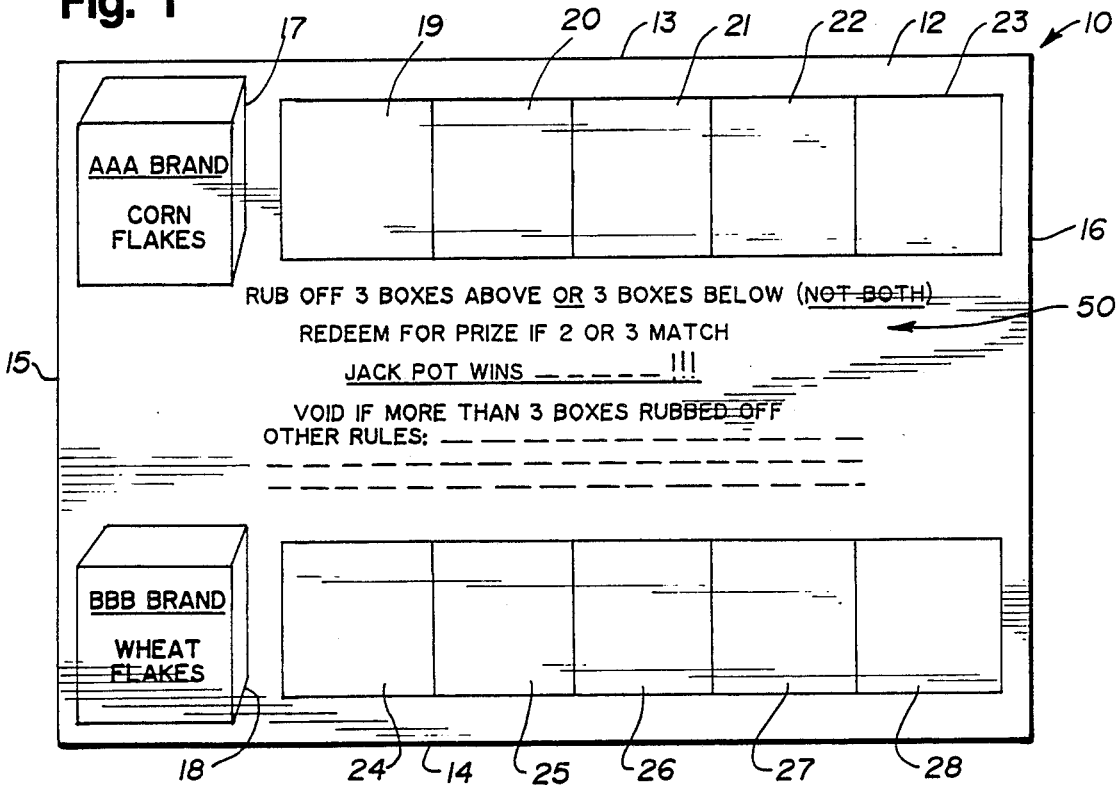
FIG. 1 is a plan view of an incentive promotional coupon constructed in accordance with the invention.

Reference numeral 10 generally designates a coupon which is constructed in accordance with the principles of the invention. The coupon 10 comprises a base member 12 of sheet material such as a paper board and, as shown, it is of rectangular form. As viewed by a recipient, it has a pair of top and bottom edges 13 and 14 and a pair of left and right edges 15 and 16. As also indicated in FIG. 1, illustrations 17 and 18 of two cereal boxes are provided on the base member 12 to provide identification of two competing products, illustration 17 showing a box of "AAA Brand Corn Flakes" and illustration 18 showing a box of "BBB Brand Wheat Flakes". The two illustrations 17 and 18 are in vertical registry with one another, being in registry along an imaginary vertical reference line parallel to the left and right edges 15 and 16, as shown, to facilitate and encourage a direct comparison therebetween.

Figure 2:
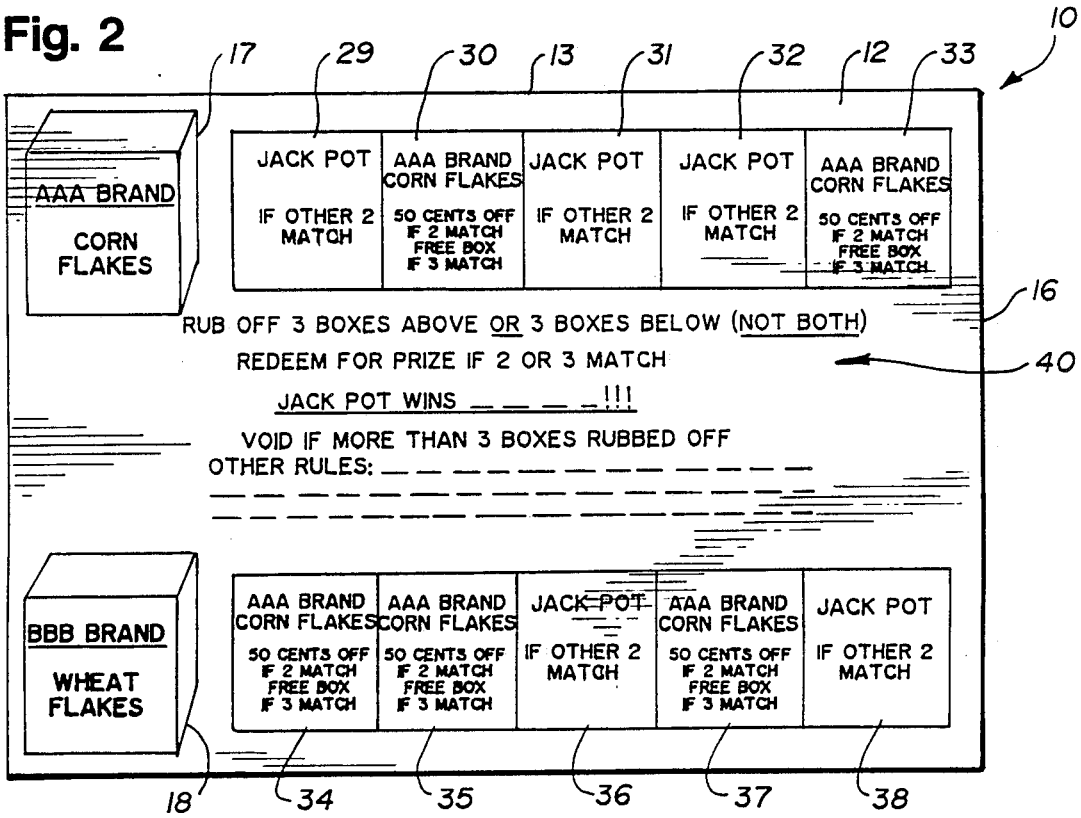
FIG. 2 is a view similar to FIG. 1, but showing a base member of the coupon before application of concealment means thereto.

The coupon 10 further includes selection means for selection of each identified product. The selection means for the product identified by illustration 17 comprises five boxes 19–23 in side-by-side relation, in horizontal registry with the illustration 17. Similarly, the selection means for the product identified by illustration 18 comprises five boxes 24–28 in horizontal registry with the illustration 18, the boxes 24–28 being respectively in vertical registry with the boxes 19–23. The selection boxes 19–28 are in the form of layers of opaque material which conceal underlying redemption value indicators 29–38, as shown in FIG. 2. Preferably, the boxes 19–28 are layers of a suitable rub-out material of a type known in the art and which is irreversibly removable so that the material cannot be removed to find out what is hidden and then replaced.

The coupon 10 further includes instruction means generally indicated by reference numeral 40 and preferably located, as shown, between the illustration 17 and associated selection boxes 19–23 and the illustration 18 and associated selection boxes 24–28. The coupon 10, as illustrated in FIGS. 1 and 2, is particularly designed for promoting the sale of products of an issuer of the coupons, such products being marketed as "AAA BRAND" products.

It will be understood that the form of the coupon 10 as illustrated, is to provide a general indication of applications of the coupons of the invention and is not to be construed as a limitation. As shown, illustrations 17 and 18 are of "AAA BRAND CORN FLAKES" and "BBB BRAND WHEAT FLAKES", respectively, the illustration 17 being assumed to be that of a product of the issuer of the coupons. The recipient of the coupon is challenged to make a selection between such two competing products and, as indicated in the instructions, he or she is instructed to rub off three of the upper series of boxes 19–23 or three of the lower series of boxes 24–28 and not both, to redeem for a prize if two or three match, the coupon being void if more than three boxes are rubbed off.

The illustrated coupon 10 is one of a very large number of coupons which are issued as a group or series of coupons which are distributed through the mail, through Sunday supplements or magazines or the like, through display cases in stores or through any of a number of other channels. The coupons of the group do not all have the same redemption values, and only one or a relatively small number of coupons may be included in each group which have very high redemption or "jackpot" values. In the particular coupon 10 as illustrated, the redemption value indicators are such that if the recipient rubs off boxes 19, 21 and 22, indicators 29, 31 and 32 will be exposed, each indicating a jackpot if the other two match. In this case, the recipient may be awarded any legal redemption value which may be appropriate. The redemption value indicators for the lower series are such that the recipient cannot win the jackpot but may nevertheless receive a redemption value, depending upon whether two or three of the uncovered indicators match.

It is important to note that in the case of the illustrated coupon and preferably in the case of all coupons of a group of issued coupons, all redemption values which are related to products are related to the "AAA BRAND" products of the issuer of the coupons and not to the competing "BBB BRAND" products, regardless of which product is selected. The result is to promote sale of the "AAA BRAND" products of the issuer of the coupons. The recipient is encouraged either to make further purchases of products from the issuer of the coupon or may be influenced to make a switch to products of the issuer of the coupons, when he selects the competing product. If desired, all coupons of a group may be such as to provide at least a small redemption value for each recipient, preferably related to a product of the issuer of the coupons. In addition to having various different redemption values, the coupons of each group may also have illustrations of various different pairings of competing products. The position of the product of the issuer of the coupons may also vary from coupon to coupon of the group, being uppermost in some coupons and lowermost in others. Thus with a sufficient number of redeemed coupons, a highly accurate estimate of the preferences of the redeemers of the coupons may be obtained.

The invention is not limited to selection between competing products and may be used to select between any other identifiable objects, including, for example competing candidates for political office, competing entries in beauty, athletic or other popularity contests, competing ideas of political or other natures, or any objects as to which polling type operations or market surveys may be used. At the same time, the redemption values are preferably related to the products or services of an issuer of the coupons so that in addition to obtaining information as to the views of the redeemers of the coupons, the issuer will obtain promotional benefits.

Figure 3:
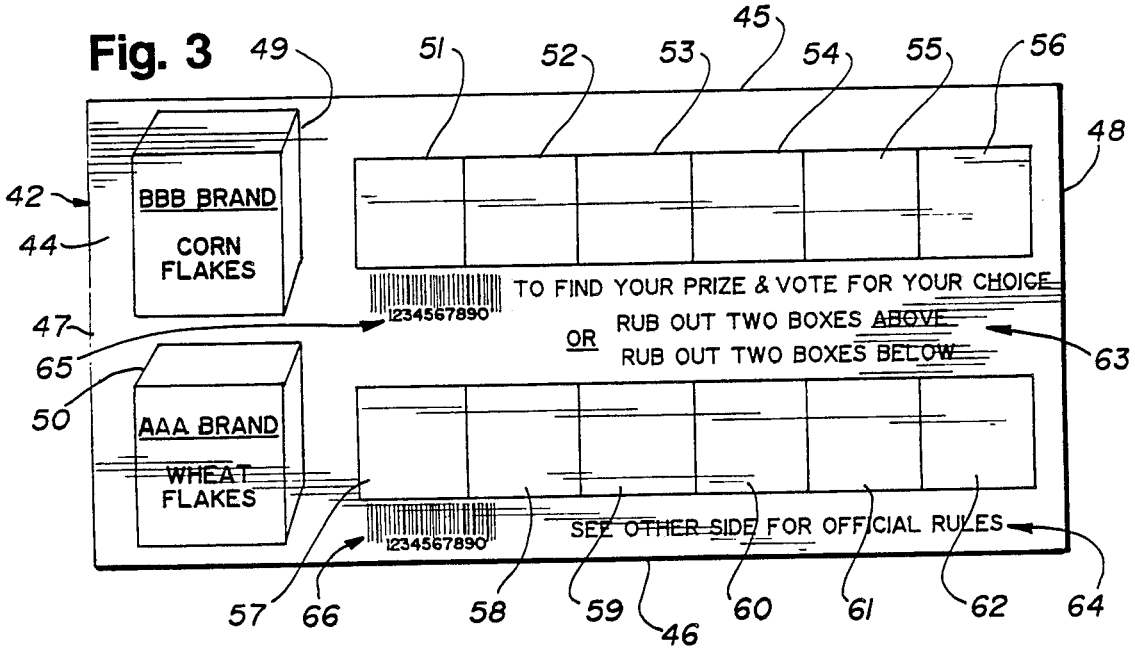
FIG. 3 is a plan view of another form of promotional coupon in accordance with the invention.

Referring to FIG. 3, reference numeral 42 generally designates a modified form of coupon which is constructed in accordance with the principles of the invention and which is one of group of coupons, including a base member 44 having top and bottom edges 45 and 46 and left and right edges 47 and 48. Illustrations 49 and 50 of two competing products are provided in vertical registry with one another, shown as "BBB BRAND CORN FLAKES" and "AAA BRAND WHEAT FLAKES", respectively. The illustration 50 is assumed to be that of a product of the issuer of the coupon and is below the illustration 49 of the competing product, but it will be understood that the illustration of the product of the issuer of the coupon may be above the illustration of the competing product in other coupons of the group.

In the illustrated coupon 42, six selection boxes 51–56 are provided opposite the illustration 49 in horizontal registry therewith and six selection boxes 57–62 are provided opposite the illustration 50 in horizontal registration therewith, the boxes 51–56 being in vertical registry with the boxes 57–62, respectively. Each of the boxes 51–62 is preferably formed of a layer of an opaque rub-out material which conceals redemption values therebelow.

Instruction means 63 are provided to tell the recipient of the coupon to rub out either two of the boxes 51–56 or two of the boxes 57–62, and additional instruction means 64 are provided to tell the user to look at the other side of the coupon for official rules. In addition, bar code imprints 65 and 66 may be provided in adjacent relation to the group of boxes 51–56 and the group of boxes 57–62, one or the other to be read by a bar code reader when the coupon is redeemed. In practice each code is different from the other and may preferably be such as to identify the selection exercised by the recipient, the issuer of the coupon, the redemption value of the coupon and such other data as may be of value. It will be understood that bar code imprints may be provided on the other illustrated embodiments of coupons.

The redemption value indications which are on the base member 44 and which underlie the boxes 51–62 are not shown in the drawings but, by way of example, may be as follows:

| Number of Overlying Box | Redemption Value Indication |
|---|---|
| 51 | AAA BRAND WHEAT FLAKES FREE BOX IF OTHER BOX MATCHES |
| 52 | AAA BRAND CORN FLAKES 75 CENTS OFF IF OTHER BOX MATCHES |
| 53 | AAA BRAND CORN FLAKES 75 CENTS OFF IF OTHER BOX MATCHES |
| 54 | AAA BRAND WHEAT FLAKES FREE BOX IF OTHER BOX MATCHES |
| 55 | AAA BRAND CORN FLAKES 75 CENTS OFF IF OTHER BOX MATCHES |
| 56 | AAA BRAND CORN FLAKES 75 CENTS OFF IF OTHER BOX MATCHES |
| 57 | AAA BRAND WHEAT FLAKES 75 CENTS OFF IF OTHER BOX MATCHES |
| 58 | AAA BRAND WHEAT FLAKES 75 CENTS OFF IF OTHER BOX MATCHES |
| 59 | AAA BRAND CORN FLAKES FREE BOX IF OTHER BOX MATCHES |
| 60 | AAA BRAND WHEAT FLAKES 75 CENTS OFF IF OTHER BOX MATCHES |
| 61 | AAA BRAND WHEAT FLAKES 75 CENTS OFF IF. OTHER BOX MATCHES |
| 62 | AAA BRAND CORN FLAKES FREE BOX IF OTHER BOX MATCHES |

All redemption values which underlie the rub-out boxes 51-62 are for the "AAA BRAND" products of the issuer of the coupons.

The opposite side of the coupon 42 is not shown in the drawings but preferably is of the following form:

OFFICIAL RULES

- - - - - - - - - - - - - - - - - - - - - -
- - - - - - - - - - - - - - - - - - - - - -
- - - - - - - - - - - - - - - - - - - - - -
- - - - - - - - - - - - - - - - - - - - - -

NAME (last-first) _____ APT. NO# __

ADDRESS _____

CITY _____ STATE _____ ZIP _____

TELEPHONE (____) ____ - _____

With this form, the rules may provide for redemption of the coupon by transmission to the issuer, through the mail or otherwise, with the redemption value to be transmitted back to the party who has redeemed the coupon. However, the rules may alternatively or additionally provide for redemption through distributors or retailers of the products of the issuer of the coupons. The inclusion of questionnaires on coupons is at the option of the issuer of the coupons.

Figure 4:
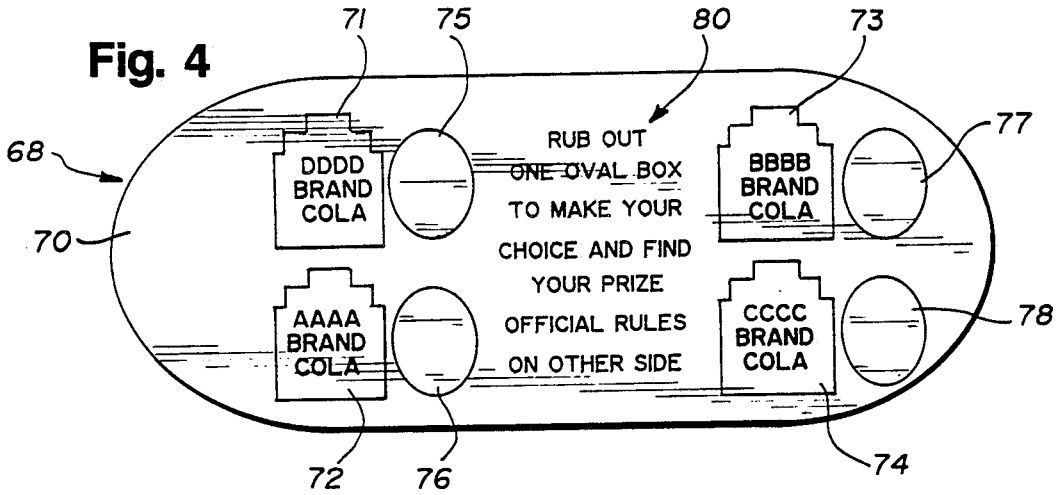
FIG. 4 is a plan view of an additional form of promotional coupon in accordance with the invention.

FIG. 4 illustrates a coupon 68 which includes a base member 70 of generally oval form and which, like the coupons 10 and 42, is one of a very large number of coupons which are issued as a group or series of coupons which have the same form and appearance and which are distributed through the mail, through Sunday supplements or magazines or the like, through display cases in stores or through any of a number of other channels. The coupons of the group or series may differ only in that they do not all have the same redemption values, and only one or a relatively small number of coupons may be included in each group which have very high redemption or "jackpot" values.

Illustrations 71–74 of four products are provided on the base member 70 with selection means adjacent thereto in the form of four selection boxes 75–78. The illustrations 71 and 72 are in vertical registry with each other and the illustrations 73 and 74 are in vertical registry with each other, so that each illustration is in vertical registry with at least one other illustration. A single selection box is provided in adjacent relation to each product illustration and in horizontal registry therewith. Each selection box 75 is preferably in the form of a layer of opaque material which conceals an underlying redemption value indication on the base member 70. Such redemption values are not shown but it will be understood that they may be similar to those shown in FIG. 2 and those described above in connection with the coupon 42 of FIG. 3, preferably with all redemption value indications being related to products or services of the issuer of the coupons.

As shown, the selection boxes 75–78 are of oval shape, but it will be understood that in the coupon 68 as well as in other coupons of the invention the selection boxes may be of rectangular shape and may alternatively be of triangular, pentagonal, hexagonal, octagonal or other polygonal shapes, or of circular or other shapes including but not limited to shapes in the form of a star, heart, a football, a bottle, a ring or other shapes and including a shape which is related to a product or logo of the issuer of the coupons. In addition, the layer of an opaque material which forms each selection box may be imprinted with instructional and/or promotional material which may include illustrations of product or logo of an issuer of the coupons.

Instruction means 80 are provided on the base member 70 to tell the recipient of the coupon to rub out only one of the four boxes 71–74 and to tell the user to look at the other side of the coupon for official rules which may be in a format as described above in connection with FIG. 3.

It will be understood that illustrations of any desired number of products or other items may be provided on a coupon and that the rules for redemption of a coupon may require the selection of a number of products or items which is greater than one.

Figure 5:
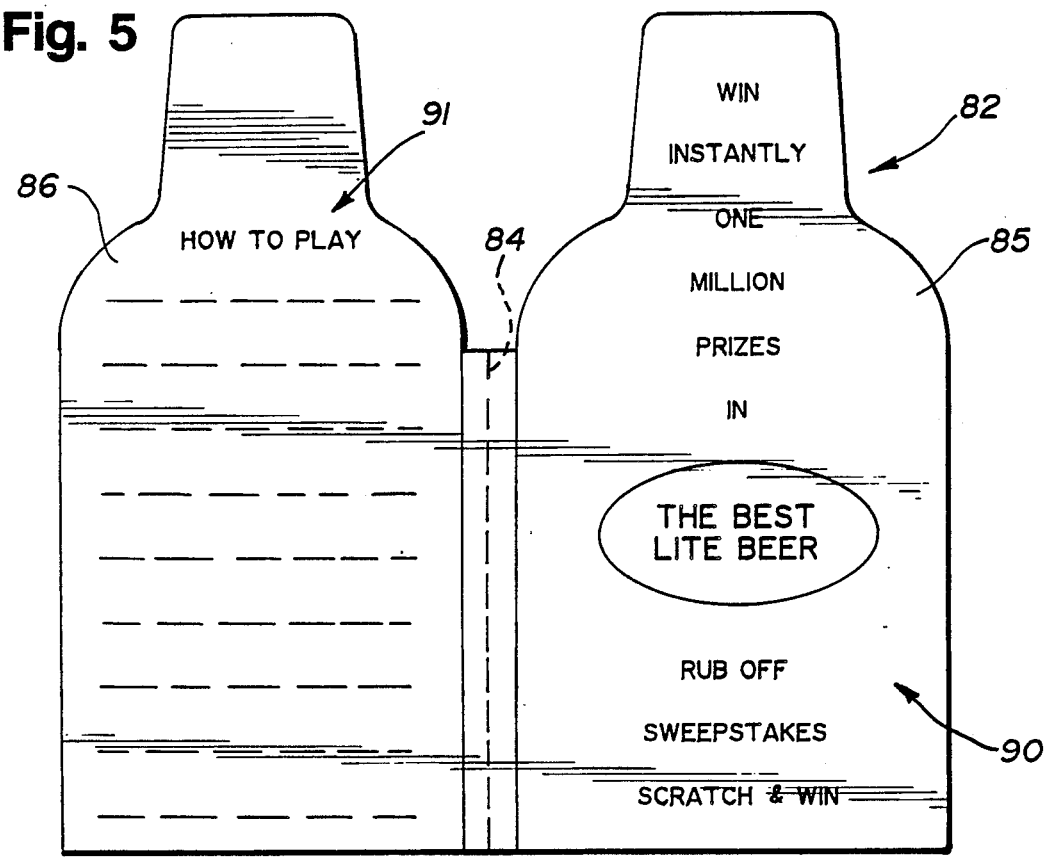
FIG. 5 is a plan view of one side of a member which is foldable to provide still another form of promotional coupon in accordance with the invention.
Figure 6:
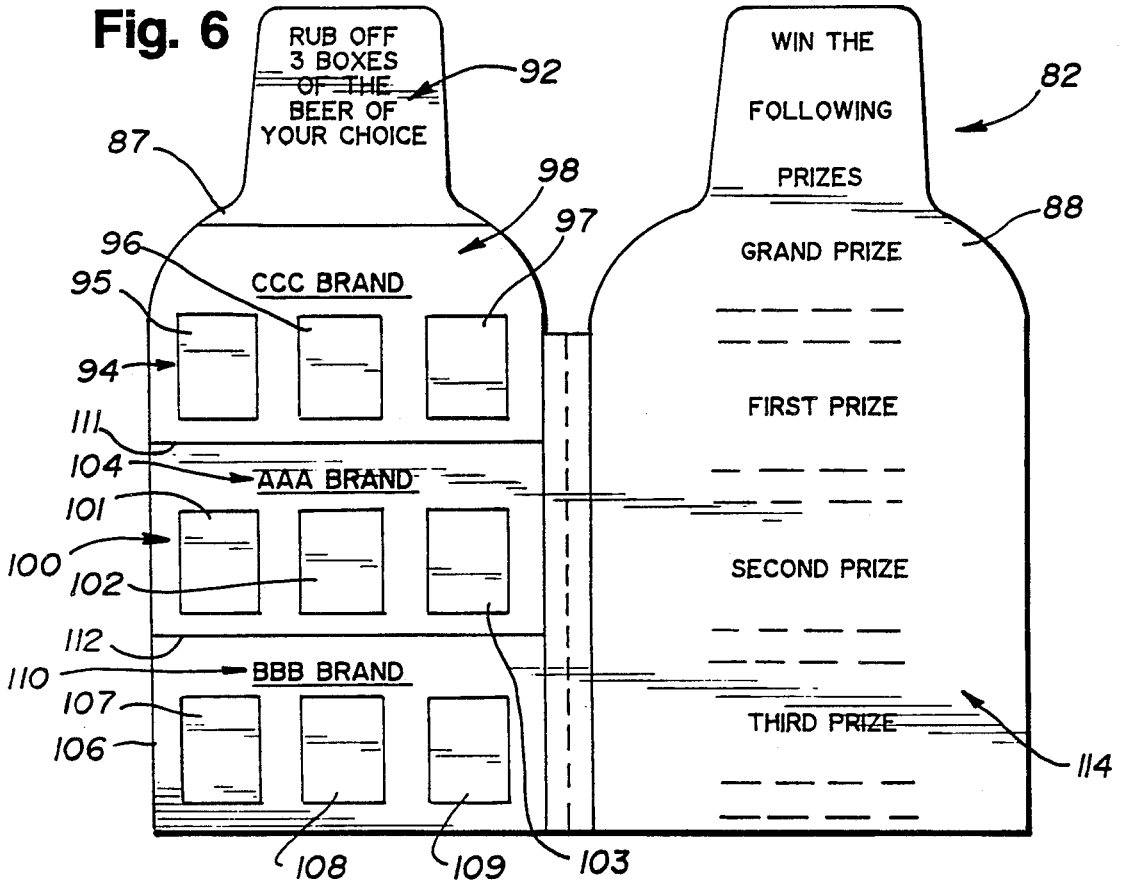
FIG. 6 is a plan view of a the opposite side of the member shown in FIG. 5.

FIGS. 5 and 6 illustrate a coupon 82 which includes a base member 84 designed to be folded along a fold line 86, indicated by a dashed line, with outside front and outside rear sections 85 and 86 on one surface of the base member 84 as shown in FIG. 5 and with inside front and inside sections 87 and 88 on the opposite surface of the base member 84 as shown in FIG. 6. The portions of the illustrated base member 84 on opposite sides of the fold line 86 are of identical form and are so shaped as to simulate the appearance of a bottle when the base member 84 is folded along the fold line 86 and is usable for asking a recipient to make a selection between a number of competing brands of bottled products such as "lite" beers.

As shown the front outside section 85 includes an illustration and instruction means 90 to simulate the appearance of a label of a bottle and to tell a recipient that he or she may win prizes in a rub off sweepstakes contest of "lite" beers. The rear outside section 86 carries instruction means 91 covering official rules and instructions for play.

The front inside section 87, as shown in FIG. 6, carries additional instruction means 92, indicating that the recipient should rub off three boxes of the beer of his or her choice, and also carries a selection means 94 in the form of three boxes 95–97 below an identification 98 of a "CCC BRAND" beer, a selection means 100 in the form of three boxes 101–103 below an identification 104 of a "AAA BRAND" beer, and a selection means 106 in the form of three boxes 107–109 below an identification 110 of a "BBB BRAND" beer. Each of the boxes 95–97, 101–103 and 107–109 is in the form of an opaque layer of a rub-out material. A horizontal line 111 is provided between selection means 94 and 100 and a horizontal line 112 is provided between selection means 100 and 106, to provide a clear separation of the three selection means.

On the rear inside section 88, instruction means 114 are provided to indicate the prizes which may be won by a participating recipient of the coupon, as indicated in FIG. 6. One or more sheets of paper may be loosely or detachably included within the folded coupon 82, in the form of a questionnaire or for other purposes at the option of the issuer of the coupons. In the coupon 82, as in the other coupons of the invention, bar code sections may be included such as illustrated in FIG. 3.

From the embodiments of the invention as illustrated in the drawings and as described herein, it will be apparent that the redemption values, the combinations required to win redemption prizes, the values of the prizes, the effective odds and other factors are within the discretion of an issuer of the coupons. It will also be apparent that the issuer may provide illustrations of the issuer's products, services, trademarks, logos and other identifications and promotional materials in a manner such as to maximize the promotional value of the coupons while at the same time obtaining information as to the views of recipients of the coupons.

It will be understood that other variations and modifications may be effected without departing from the spirit and scope of the novel concepts of this invention.

I claim:

1. Promotional coupons for display of products and obtaining information as to issues of preference, each coupon comprising: a base member of sheet material having on one face thereof an instruction region for display of instructions, a plurality of product identification regions separate from said instruction region and from each other and a plurality of selection regions separate from said instruction region and from each other and each being in close proximity to and in registry with a corresponding one of said product identification regions, a plurality of product identification means on said product identification regions of said base member arranged for displaying identifications of products one of which is to be selected by a user of the coupon, a plurality of selection means on said selection regions of said base member, each selection means being so located on one of said selection regions as to be clearly associated visually with the one of said product identification means which is located on the corresponding product identification region, each of said selection means comprising redemption value exhibiting means for exhibiting a redemption value for said coupon, removable concealment means covering said redemption value exhibiting means, and instruction indicia means located on said instruction region for instructing a user of the coupon that the concealment means of only one of said selection means should be removed by the user so that removal of the concealment means of one of said selection means shows a preference for the product identified by the product identification means associated with said elected selection means, and said redemption value exhibiting means being operative to provide the user with an incentive to redeem said coupon, whereby to promote the redemption of each said coupon and whereby each redeemed coupon provides information as to the preference of a user as between the products identified by said identification means.

2. Promotional coupons as defined in claim 1, wherein each of said concealment means comprises an opaque layer for removal in an irreversible manner to reveal said redemption value exhibiting means, whereby the redemption value of the coupon is finally determined upon removal of the concealment means which determines the selection of one of said products.

3. Promotional coupons as defined in claim 1, wherein each said selection means comprises a certain number of said redemption value exhibiting means and a corresponding number of said removable concealment means, and each product being elected by removal of at least one concealment means of the selection means associated with the identification means for identifying the elected product.

4. Promotional coupons as defined in claim 3, wherein each redemption value exhibiting means of each said selection means exhibits one of a plurality of redemption values and wherein each product is selected by removal of a first number of the concealment means of the selection means associated with said elected product said first number being less than said certain number and wherein the redemption value is conditioned upon the removal of particular concealment means of said selection means.

5. Promotional coupons as defined in claim 3, wherein at least two of the redemption value exhibiting means of each selection means have matching characteristics and wherein the redemption value is conditioned upon the removal of a plurality of concealment means of one said selection means which cover redemption value exhibiting means having matching characteristics.

6. Promotional coupons as defined in claim 1, wherein one of said product identification means and the corresponding selection means are in register along a reference line and wherein other said product identification means and the corresponding selection means are each in register along a line parallel to said reference line and wherein each of said selection means is in register with at least one other selection means along a line transverse to said reference line, to thereby provide an orthogonal format which facilitates a selection between products and correlation of said selection means and the corresponding product to be selected.

7. Promotional coupons as defined in claim 6 wherein said base member is of generally rectangular form with a pair of left and right edges and a pair of lower and upper edges, and wherein said selection means are arranged in groups with a certain number of said selection means in each group, each group corresponding to one of said product identification means and being in registry therewith along a line parallel to one of said pairs of edges.

8. Promotional coupons as defined in claim 7, wherein each of said groups of selection means and the corresponding product identification means are in registry along a line parallel to said upper and lower edges, said instruction indicia located on said coupon instruction region between two of said groups.

9. Incentive redemption coupons for promoting sales of products of a single issuing vendor, each of said coupons comprising a base member of sheet material and of generally rectangular form with a pair of left and right edges and a pair of lower and upper edges, a pair of object identification means in vertical registry and adjacent said left side edge, one of said pair of object identification means being in the form of an illustration of a product of the issuing vendor and the other being in the form of an illustration of a competing product, a first group of selection means arranged horizontally in registry with one of said pair of object identification means, a second group of selection means arranged horizontally in registry with the other of said pair of object identification means, said first and second groups of selection means being in vertical registry, each of said selection means comprising redemption value indicating means on said base member and an irreversibly removable rub-out layer of opaque material covering said redemption value indicating means, all of said redemption value indicating means being related to products of the issuing vendor.

* * * * *